US005979498A

United States Patent [19]

Zenker et al.

[11] Patent Number: 5,979,498

[45] **Date of Patent: *Nov. 9, 1999**

[54] THREE-WAY OR MULTI-WAY VALVE

[75] Inventors: Siegfried Zenker, Kirchseeon, Germany; Jens Jørgen Nielsen, Broager; Erik Plauborg, Sønderborg, both of Denmark

[73] Assignee: Danfoss A/S, Nordborg, Denmark

[ * ] Notice: This patent is subject to a terminal disclaimer.

[21] Appl. No.: 08/875,555

[22] PCT Filed: Jan. 10, 1996

[86] PCT No.: PCT/DK96/00006

§ 371 Date: Oct. 8, 1997

§ 102(e) Date: Oct. 8, 1997

[87] PCT Pub. No.: WO96/21807

PCT Pub. Date: Jul. 18, 1996

[30] Foreign Application Priority Data

Jan. 12, 1995 [DE] Germany ..... 195 00 749

[51] Int. Cl.[6] ..... F15B 13/043

[52] U.S. Cl. ..... 137/596.15; 91/454; 137/596.16

[58] Field of Search ..... 137/596.15, 596.16; 91/454

[56] References Cited

U.S. PATENT DOCUMENTS

| | | | |
|---|---|---|---|
| Re. 26,523 | 2/1969 | Tennis | 91/454 |
| 2,984,218 | 5/1961 | Christianson | 137/596.15 |
| 3,411,536 | 11/1968 | Tennis | 137/596.15 |
| 3,800,670 | 4/1974 | Hufeld et al. | 91/454 X |

*Primary Examiner*—Gerald A. Michalsky
*Attorney, Agent, or Firm*—Lee, Mann, Smith, McWilliams, Sweeney & Ohlson

[57] ABSTRACT

A three-way or multi-way valve is provided, which is built up of a plurality of two-way valves, each of which has a high pressure connection and a low pressure connection which are separated from each other by means of a valve seat with which a closure element co-operates, the two-way valves being arranged to be operated in pairs or in groups by means of a control pressure fluid by way of a control pressure line opening into a pressure chamber, and one of the two-way valves of each group being arranged in a connection between a pressure source and a load, and another two-way valve of the same groups being arranged in a connection between the load and a pressure sink. With a valve of this type, it is desired to obtain improved closing behavior with simple construction. For this purpose, at least one of the connections, especially the high pressure connection, of at least one valve of each group communicates with the control pressure line by way of a throttle channel.

7 Claims, 2 Drawing Sheets

THREE-WAY OR MULTI-WAY VALVE

BACKGROUND OF THE INVENTION

The invention relates to a three-way or multi-way valve, which is built up of a plurality of two-way valves, each of which has a high pressure connection and a low pressure connection which are separated from each other by means of a valve seat with which a closure element co-operates, the two-way valves being arranged to be operated in pairs or in groups by means of a control pressure fluid by way of a control pressure line opening into a pressure chamber, and one of the two-way valves (pump valve) of each group being arranged in a connection between a pressure source and a load, and another two-way valve (tank valve) of the same groups being arranged in a connection between the load and a pressure sink.

A valve of this type is known from DE 22 58 853 B2. The two-way valves are in that case built up in the manner of a bridge, in which the individual two-way valves are arranged in the arms of the bridge, the load is connected up by way of one diagonal of the bridge, and the other diagonal lies between a pump acting as pressure source and a tank acting as pressure sink. The two-way valves are actuated by means of control valves which raise or lower the pressure in the pressure chamber.

Valves of this type are used as hydraulic valves for controlling fluid flow and fluid pressures. They function without any problem, as long as oil, especially a synthetic hydraulic oil, is used as hydraulic fluid.

For some time, however, attempts have been made to replace the hydraulic oils, especially the synthetic hydraulic oils, by means of water, because of their somewhat questionable properties, from the environmental point of view, and especially of their toxicity. However, water has practically no lubricating properties, and, moreover, in many cases leads to corrosion damage, so that valves of this type wear out relatively quickly, or even seize up, so that they can no longer fulfil their function or can no longer do so to a satisfactory degree.

A two-way seat-type valve has therefore already been proposed (DE 36 37 208 C2) for fluids consisting essentially of water, in which the closure element of the two-way valve is prevented from coming into contact with the guide, that is to say, with the housing surrounding it. For this purpose, sliding rings of plastics material are provided which surround the closure element. Between two sliding rings of this type a seal is arranged. At all events, the closure element of such a valve offers a resistance to movement which is somewhat considerable, and is caused by the sliding rings and the sealing rings. A pre-requisite for a valve of this type is therefore the necessary pressure build up for both directions of movement of the closure element. This is provided, for example, in DE 22 58 853 B2 by the possibility of connecting the control pressure line to the pump by way of a control valve. This, however, entails a relatively complex construction of the valve and makes operation more difficult.

The problem underlying the invention is that of obtaining good closing behaviour with simple operation.

SUMMARY OF THE INVENTION

This problem is solved in a valve of the type mentioned initially by the fact that at least one of the connections, especially the high pressure connection, of at least one valve of each group communicates with the control pressure line by way of a throttle channel.

By way of this throttle channel it is now possible to build up the pressure in the pressure chamber without the control pressure channel having to be brought into communication with a pressure source by way of a separate valve. The routing of the channel within the valve is thereby simplified. The pressure build-up in the pressure chamber is now simply obtained through the throttle channel. A result of this is the additional advantage that the pressure in the pressure chamber is automatically matched to the pressure of the pressure source.

It is of advantage that the control pressure line is connected to the pressure sink. Through the throttle channel, with the valves closed at least the pump pressure always builds up in the control pressure line. It is therefore not necessary to supply the control pressure line with pressure by way of a separate pressure supply. The individual two-way valves can be operated by way of a pressure decrease in the respective control pressure line. For this purpose, control valves are of course provided in the control pressure line which provide a controlled connection of the control pressure line to the pressure sink.

In a preferred embodiment, the throttle channel is arranged in the closure element. The closure element is in many cases easier to machine than the valve housing. When the throttle channel is arranged in the closure element, exchanging it, and thus the adaptation of the characteristics of the throttle means to differing requirements, is easier to achieve. This also facilitates the stockholding for such valves.

Preferably, the throttle channel of the pump valve has a non-return valve opening in the direction of the pressure chamber. By this means it is ensured that a pressure can in fact build up in the pressure chamber through the throttle channel. A back flow of fluid is, however, prevented by means of the non-return valve. The pressure that has once built up is maintained, that is to say, it acts in the closing direction.

The closure element is advantageously guided seal-lessly in the guide. By this means, a certain leakage past the closure element in the direction of the pressure chamber is allowed. This does indeed entail certain losses, which are relatively small. However, this makes it possible for a fluid layer or a fluid film to build up between the guide and the closure element, which in many cases allows the closure element to slide with low friction in the guide. Moreover, with a construction without seals, improved and more uniform operating behaviour is obtained. In the case of a construction with one or more sealing rings, the opening and closing times may differ from valve to valve. This is attributable on the one hand to scarcely avoidable tolerances with corresponding variations in stresses between the closure element and the guide, and on the other hand to differing wear. Moreover, seals have only a limited service life and change the dynamic characteristics in the course of time, owing to wear. If no seals are used, the dynamic characteristics remain the same over a longer period. This is of importance especially when several valves are connected together in such a way, for example in a bridge, that in the case of a too rapid opening movement or a too slow closing movement of one valve a short-circuit can occur between the pressure source and the pressure sink. Without seals, the speeds once set up can be maintained over a relatively long period.

Preferably, the pressure chamber is connected to a control line by way of a non-return valve opening away from the pressure chamber. When sealing between the closure element and the guide is omitted, and a certain leakage is thus allowed past the closure element, this naturally results in certain problems if the two-way seat-type valve is connected to a common control line with other correspondingly constructed valves. In this case, a pressure increase arising in the control pressure line through the leakage in one valve can advance past the closure element into one connection of the other valve. The non-return valve now prevents such an uncontrolled pressure increase in the connection in question of the valve.

In a preferred embodiment, provision is made for both connections of the pump valve to be connected to the pressure chamber, a non-return valve opening towards the pressure chamber being arranged in each connecting line. In such an embodiment it is ensured that the higher of the two pressures prevailing in the connections is always used to produce the closing force. Owing to the fact that in the case of a pressure increase the hydraulic fluid is first diverted into the pressure chamber, there is no risk that a pressure increase in one of the two connections will accidentally open the closure element.

In this context, it is especially preferred that a throttle means common to both non-return valves is arranged between the pressure chamber and the two non-return valves. The higher pressure of the two connections opens the associated non-return valve. This higher pressure is thus applied directly to the outlet of the other non-return valve and prevents it from opening. The fluid from the connection having the higher pressure can then only continue to advance into the pressure chamber, without leading to a pressure increase in the other connection and any further valves that may be connected thereto.

To especial advantage, the fluid pressure from the low pressure connection acts at the end face on the closure element and the fluid pressure from the high pressure connection acts substantially on the periphery of the closure element. With this embodiment, a radial flow against the closure body is obtained, since the fluid normally flows from the high pressure connection to the low pressure connection, although it is not to be excluded that the pressure at the low pressure connection, under certain operating conditions, may briefly be higher than that at the high pressure connection. The fluid from the high pressure connection surrounds the closure body on all sides, so that the risk of misalignment becomes less. Such misalignment, in the case of contact between the closure element and the guide, leads to a relatively high surface pressure, which can no longer be taken up by way of the thin film of water, so that misalignment should be avoided. By means of the flow behaviour produced, however, this risk is drastically reduced.

Preferably, the two-way valves each have an auxiliary force device acting in the closing direction. This may, for example, be in the form of a compression spring. In the case of a pressure equilibrium on both sides of the closure element, this spring has the effect that the closure element moves in the direction of the corresponding valve seat and closes the valve. This improves the closing behaviour and increases the operating safety.

It is also preferred that all two-way valves are arranged in a common housing, in which the closure elements are movable in a first direction and all lines to the pressure source, to the pressure sink and to the load extend substantially at right-angles to that direction. By this means, the construction of the housing is drastically simplified. This is true especially when individual two-way valves are arranged so as to be offset axially with respect to one another. In this case, the individual channels may in fact be allowed to extend substantially in a straight line. It is therefore possible to do without oblique bores.

BRIEF DESCRIPTION OF THE DRAWINGS

The invention is described hereinafter with reference to a preferred exemplary embodiment in conjunction with the drawing, in which.

DESCRIPTION OF THE PREFERRED EMBODIMENT

Figure 1:
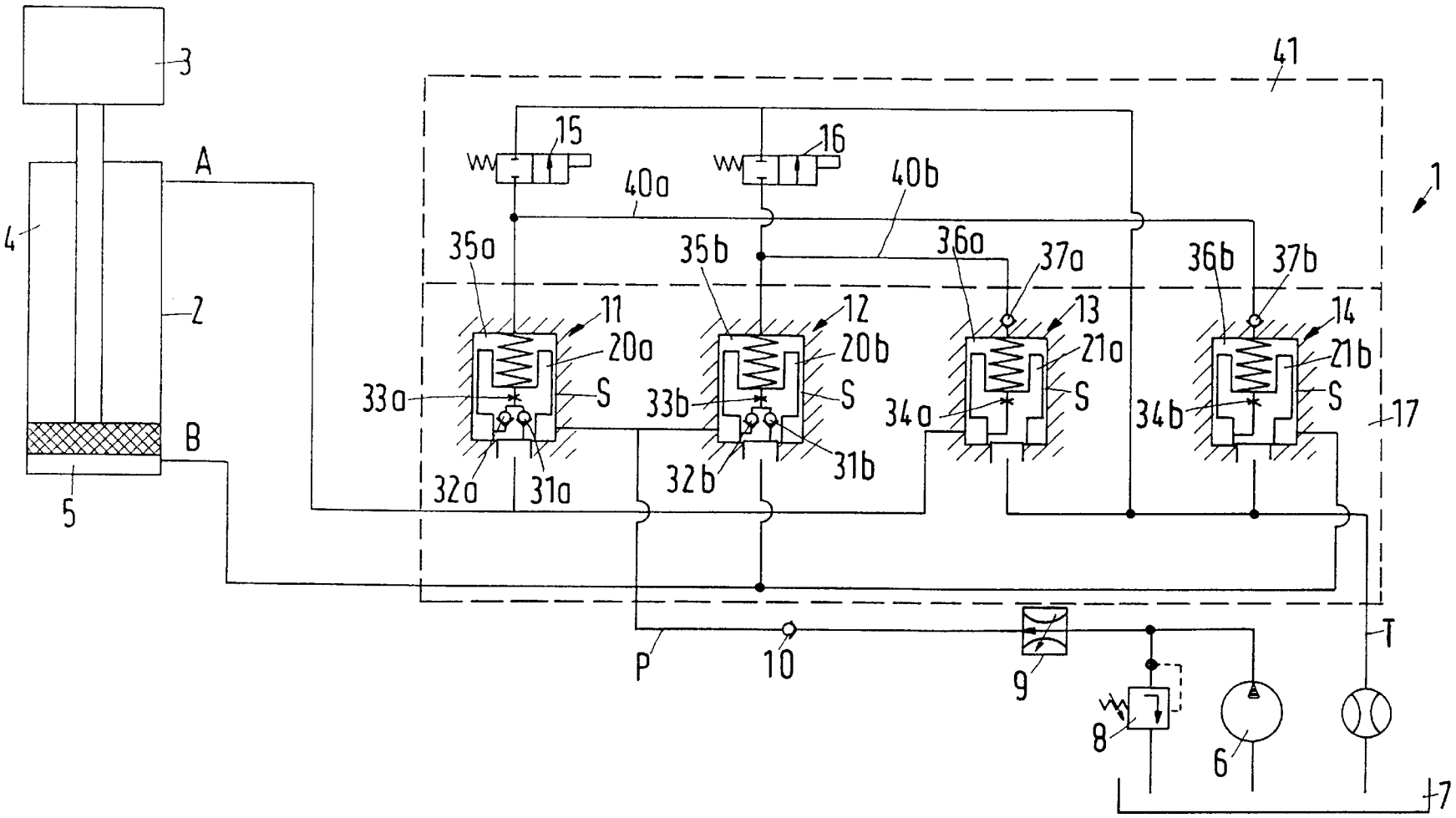
FIG. 1 shows in diagrammatic view a 4/3-way valve built up of a plurality of two-way valves.

FIG. 1 shows diagrammatically a 4/3-way valve 1, thus a valve with four connections and three positions, which serves to control a hydraulic piston motor 2 which is to raise or lower a load 3. For this purpose, the motor 2 has two control lines A and B which open into working chambers 4, 5 of the motor 2. The four-way valve is here arranged in a known manner between a pump 6 which serves as pressure source and a tank 7 which serves as pressure sink. Downstream of the pump 6 are connected a pressure regulator 8 and a flow limiting means 9, as well as a non-return valve 10 opening in the direction of the four-way valve 1. The four-way valve 1 has connections P (to the pump), T (to the tank) and A, B (to the motor 2).

The 4/3-way valve is built up of four two-way valves 11, 12, 13 and 14, two of which communicate with the pump 6, and are therefore designated as pump valves 11, 12, and the other two communicate with the tank 7, and are therefore designated as tank valves 13, 14.

The 4/3-way valve is built up in the manner of a bridge circuit, in which the two-way valves 11 to 14 are arranged in the arms of the bridge, while one diagonal lies between the pump 6 and the tank 7, and the other diagonal lies between the working connections A, B of the motor 2. Accordingly, the individual valves are always operated in pairs, by means of control valves 15, 16, which are in the form of electromagnetic valves and are arranged in a control housing 41. The control valve 15 controls the actuation of the valves 11 and 14, while the control valve 16 controls the actuation of the valves 12 and 13.

Figure 2:
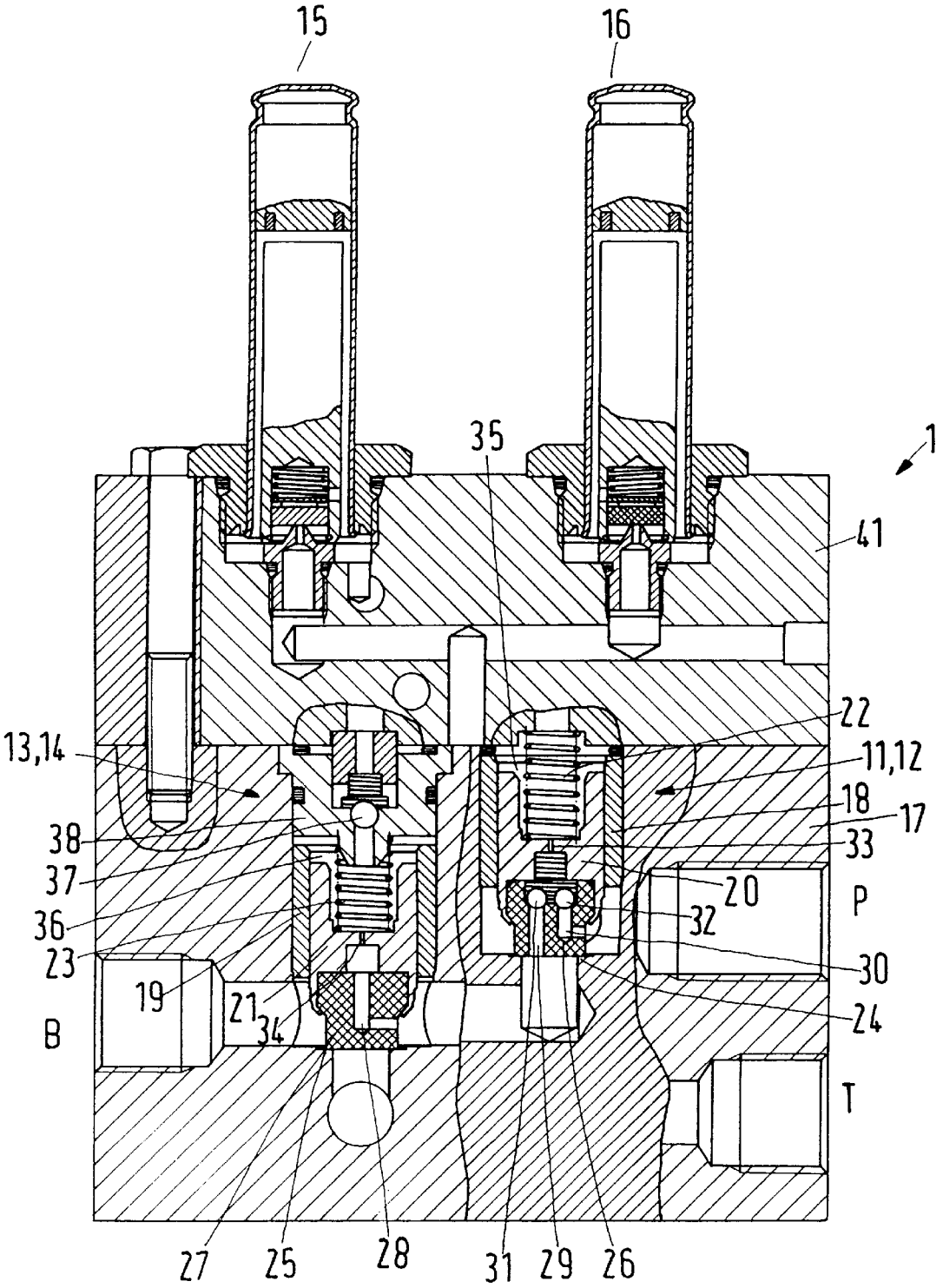
FIG. 2 shows a diagrammatic section through a two-way valve.

The construction of the valves 11 to 14 is revealed by FIG. 2.

In a valve housing 17, which is connected to the control housing 41, there is provided for each two-way valve 11 to 14 a bushing 18, 19 which is formed, for example, of brass or of a material from the group of high-strength thermoplastic plastics materials based on polyaryletherketones, especially polyetheretherketones, polyamides, polyacetals, polyarylether, polyethyleneterephthalates, polyphenylenesulphides, polysulphones, polyethersulphones, polyetherimides, polyamidimide, polyacrylates, phenolic resins, such as novolak resins, or the like, wherein glass, graphite, polytetrafluoroethylene or carbon, especially in fibre form, can be used as fillers.

Further, each valve 11 to 14 has a closure element 20, 21 having a bearing portion of stainless steel. The material pairing between the bushing 18, 19 and the closure element 20, 21 is in any case so selected that the two parts can slide with low friction upon each other. Since the valve is to be operated with water as the hydraulic fluid, a further prerequisite is that both materials are corrosion-resistant. Each closure element is subjected by a spring 22, 23 to a closing force which presses the closure element 20, 21 in the direction of a valve seat 24, 25. In order to improve the leak-tightness, the closure element 20, 21 is provided at the end facing towards the valve seat 24, 25 with an insert 26, 27 of plastics material. While the valve seats 24, 25 may likewise be formed of stainless steel and therefore have a certain hardness, the plastics material of the inserts 26, 27 is softer, so that the valve seat can press itself into the insert and therefore results in a tight seal.

The inserts 26, 27 differ between the pump valves 11, 12 and the tank valves 12, 14. The insert 27 of the tank valves 13, 14 has a simple channel 28 which communicates with the corresponding working connection A, B of the motor 2. Since the pressure at this working connection A, B, in operation, is normally higher than at the tank connection T, this connection is also designated as a high pressure connection, while the tank connection T is designated as a low pressure connection.

In the same way, the pump valves 11, 12 have a high pressure connection P which communicates with the pump 6, and a low pressure connection which communicates with the working connections A, B of the motor 2.

The designations "high pressure connection" and "low pressure connection" hereby serve only to differentiate between the two connections. Situations may very likely arise in which the pressure at the low pressure connection is greater than that at the high pressure connection.

In the pump valves 11, 12, the insert 26 has two channels 29, 30 in each of which a non-return valve 31, 32 is arranged. Both non-return valves open away from the connections, and therefore block a back flow of fluid into the high pressure or low pressure connection. The non-return valves 31, 32 are each formed by means of a spring-loaded stainless steel ball, which presses itself into a valve seat in the insert 26. Since the insert 26, as mentioned above, is formed of plastics material, the ball can here, after a short time, shape the valve seat in such a way that the non-return valves are to a great extent leaktight.

Both closure elements 20, 21 have a throttle channel 33, 34, the throttle channel 33 being arranged between the non-return valves 31, 32 and a pressure chamber 35 in the case of the pump valves 11, 12, while the throttle channel 34 is arranged between the channel 28 and a pressure chamber 36 in the case of the tank valves.

In a manner which is not shown, in the control valves 15, 16 there are also throttles leading to the tank, but in any case with a greater resistance than in the closure elements 20, 21, so that the corresponding control pressure can build up.

In series with the tank valves 13, 14 is arranged a further non-return valve which opens away from the pressure chamber 36 and which is formed of a stainless steel ball 37, which is pressed, loaded by springs, into an insert 38 of plastics material which is fixedly arranged in the valve housing 17.

The springs of the non-return valves should be weaker than the springs 22, 23, of the closure elements.

As revealed by FIG. 2, the tank valves 13, 14 and the pump valves 11, 12 are offset axially with respect to one another, so that arranging the conduits without oblique bores is made easier.

The closure elements 20, 21 are guided without seals, therefore seal-lessly, in the bushings 18, 19. In order to make this state of affairs clear, in FIG. 1 a gap s is therefore shown between the guides, formed by the bushing 18, 19, and the closure elements 20, 21. In the diagrammatic view of FIG. 1, this gap s is shown greatly exaggeratedly. In reality it is much smaller. In any case, however, it is of a size such that water, which is here used as hydraulic fluid, can flow past the respective closure element 20, 21.

Since the pressure chambers 35, 36, which in order to differentiate between the two pump valves 11, 12 and the two tank valves 13, 14 are in each case provided with the suffixes a and b, are in each case connected to one another in pairs, it could happen that, in the case of the seal-less construction of the valves 11 to 14, fluid with pump pressure flows past the closure elements 20 of the pump valves 11, 12 into the pressure chamber 35 and thence into the pressure chamber 36 of the tank valves 13, 14. Since the closure elements there are also mounted seal-lessly in the bushings, the pressure could then pass into the high pressure connection, that is to say, supply pressure to the working connections A, B of the motor 2. The non-return valves 37*a*, 37*b*, however, prevent the pressure from the pressure chamber 35 from advancing into the pressure chambers 36. By this means, despite the seal-less guiding of the closure elements, a leaktight 4/3-way valve is obtained.

The 4/3-way valve 1 operates in the following manner: water, which is conveyed by the pump 6 into the pump connection P, flows past the closure elements 20, 21 into the pressure chambers 35, 36, which are connected to one another in pairs in each case by way of a pressure control line 40*a*, 40*b*, and thus presses the closure elements 20, 21 onto the valve seats 24, 25. All two-way valves 11, 12, 13, 14 are thus closed. The fluid can here pass on two paths into the pressure chambers 35, 36, on the one hand through the gap s, the amount passing through being only relatively small here. The major part of the fluid will pass through the throttle channel 33, 34. If it is now desired to move the motor 2 in a certain direction, for example to raise the load 3 in the diagrammatic view of FIG. 1, the pressure in the working connection B of the motor 2 must be increased. For this purpose, the control valve 16 is opened. The pressure chambers 35*b*, 36*a* are now relieved of pressure, since the outlet of the control valves 15, 16 communicates with the tank T. By means of the pump pressure prevailing in the high pressure connection of the two-way valve 12, the closure element 20*b* is raised from the valve seat and water with the pump pressure flows into the working connection B. It is of course a pre-requisite here that the closure element 20 has a pressure engagement surface on which the pressure in the high pressure connection can act.

During the upward movement of the load 3, water which passes to the high pressure connection of the two-way valve 13 is now displaced into the working connection A and there raises the closure element 21*a*, so that the displaced water can flow back to the tank 7. The pressure decrease in the pressure chamber 36*a* is possible because the non-return valve 37*a* opens in the direction of the control valve 16.

If the operation of the motor is now to be terminated, the control valve 16 closes again, so that the pressure in the pressure chambers 35*b* and 36*a* increases. In the case of motors which, as in the case illustrated, may have differing pressures at their working connections A, B, for example, differential cylinders, it may now happen that the two-way valve 13 closes, while the two-way valve 12 is still open. The pump valves 11, 12 are always supplied with the full pump pressure, while the tank valves open only wide enough to allow through the fluid flowing back from the working motor. Since the pressure at the working connection A is higher than at the working connection B, it could now happen that the pressure in the working connection A opens the two-way valve 11. Since, however, the two non-return valves 31, 32 are arranged in the pump valves 11, 12, the higher of the two pressures in the connections separated by means of the valve seat 24 always advances into the pressure chamber 35, in order there to produce the necessary closing force. Also in the case of the differential cylinder shown as the motor 2, therefore, reliable control is possible, even when water, which has no lubricating properties, is used as hydraulic fluid.

The non-return valves 32 furthermore have a certain importance from the safety point of view, in a case in which the following conditions prevail: the valve 1 is in the neutral position, the motor 2 is under load, the non-return valve 10 is not very fluidtight, and the pump 6 is switched off or is defective. In this case, the fluid would flow away from the working connection which was under pressure, directly to the pump connection. The load would descend very rapidly. If the non-return valve 32 is now built into this connection, there is still a connection, by way of the gap s, between the working connection and the pump connection. The fluid flow, however, is kept considerably smaller here.

We claim:

1. Multi-way valve, which is built up of a plurality of two-way valves, each of which has a high pressure connection and a low pressure connection which are separated from each other by means of a valve seat with which a closure element co-operates, the two-way valves being arranged to be operated in groups by means of a control pressure fluid by way of a control pressure line connected to a pressure chamber of each two-way valve of each group, and one of the two-way valves of each group comprising a pump valve and being arranged between a pressure source and a load, and another two-way valve of the same group comprising a tank valve and being arranged between the load and a pressure sink, at least one of the connections of at least one valve of each group communicating with the control pressure line by way of a throttle channel in the closure element such that pressure to the control pressure line in communicated through the closure element, both connections of the pump valve being connected to the pressure chamber and including a non-return valve in each connecting line opening in the direction of the pressure chamber, a throttle means common to both non-return valves between the pressure chamber and the two non-return valves, and including a control selectively connecting each control pressure line to the pressure sink.

2. Valve according to claim 1, in which the throttle channel of the pump valve has a non-return valve opening toward the pressure chamber.

3. Valve according to claim 1, in which the closure element is guided seallessly in a bushing.

4. Valve according to claim 1, in which the pressure chamber of the tank value is connected to the control pressure line by way of a non-return valve opening away from the pressure chamber.

5. Valve according to claims 1, in which fluid pressure from the low pressure connection acts at an end face on the closure element and the fluid pressure from the high pressure connection acts substantially on the periphery of the closure element.

6. Valve according to claims 1, in which the two-way valves have an auxiliary force device acting in the closing direction.

7. Valve according to claim 1, in which the two-way valves are arranged in a common housing in which the closure elements are movable in a first direction and all lines to the pressure source, to the pressure sink and to the load extend substantially at right-angles to that direction.

* * * * *